US007472654B2

(12) United States Patent
Davies et al.

(10) Patent No.: US 7,472,654 B2
(45) Date of Patent: Jan. 6, 2009

(54) TRAIN FOR THE DEPLOYMENT OF SLEEPERS AND OR RAILWAY TRACK

(75) Inventors: William R. Davies, York (GB); Patrick A. McHale, Hatfield Chase (GB)

(73) Assignee: Fastline Limited, North Yorkshire (GB)

( * ) Notice: Subject to any disclaimer, the term of this patent is extended or adjusted under 35 U.S.C. 154(b) by 246 days.

(21) Appl. No.: 10/504,399

(22) PCT Filed: Feb. 7, 2003

(86) PCT No.: PCT/GB03/00561

§ 371 (c)(1),
(2), (4) Date: Aug. 31, 2005

(87) PCT Pub. No.: WO03/068656

PCT Pub. Date: Aug. 21, 2003

(65) Prior Publication Data

US 2006/0037510 A1 Feb. 23, 2006

(30) Foreign Application Priority Data

Feb. 12, 2002 (GB) ..... 0203223.3

(51) Int. Cl.
*E01B 29/02* (2006.01)

(52) U.S. Cl. ..... 104/3

(58) Field of Classification Search ..... 104/2, 104/3, 5, 6, 9; 410/44, 45
See application file for complete search history.

(56) References Cited

U.S. PATENT DOCUMENTS

| | | | | | |
|---|---|---|---|---|---|
| 805,881 | A | * | 11/1905 | Ritchie | 104/3 |
| 1,826,069 | A | * | 10/1931 | Guilbert et al. | 104/2 |
| 2,458,050 | A | * | 1/1949 | Blondelle | 104/5 |
| 2,696,791 | A | * | 12/1954 | Boulard | 104/3 |
| 3,283,926 | A | * | 11/1966 | Stiefel et al. | 104/3 |
| 3,330,219 | A | * | 7/1967 | Plasser et al. | 104/2 |
| 4,046,077 | A | * | 9/1977 | Theurer et al. | 104/2 |
| 4,178,724 | A | * | 12/1979 | Bruno | 451/347 |
| 4,232,610 | A | * | 11/1980 | Theurer | 104/3 |
| 4,270,456 | A | * | 6/1981 | Theurer et al. | 104/3 |
| 5,174,211 | A | * | 12/1992 | Snead | 104/3 |
| 5,595,313 | A | * | 1/1997 | Kroll et al. | 104/3 |
| 5,666,882 | A | * | 9/1997 | Theurer et al. | 104/3 |

* cited by examiner

*Primary Examiner*—Lars A Olson
(74) *Attorney, Agent, or Firm*—Mark A. Tidwell; Jackson Walker L.L.P.

(57) ABSTRACT

A rail wagon (100, 400, 500, 700) is disclosed for the deployment of a panel of track or sleeper set from the wagon to an adjacent substantially parallel track bed in a single laying operation. Each wagon comprises a crane hoist (102, 403, 504) moveable from a transit position to an operational position and at least one stabilizing member in the form of an outrigger having an arm (108) and foot portion (109) to prevent tipping of the rail wagon during track or sleeper deployment. Methods of deployment of panels of pre-formed track and sleeper sets are also disclosed.

22 Claims, 7 Drawing Sheets

TRAIN FOR THE DEPLOYMENT OF SLEEPERS AND OR RAILWAY TRACK

FIELD OF THE INVENTION

The present invention relates to railroads, and particularly, although not exclusively, to the laying of railway track, sleepers and rail.

BACKGROUND TO THE INVENTION

Conventional railway track, which has been well known in the art for more than one hundred years, and of which millions of miles of track is in existence, comprises a pair of spaced apart metal rails, rigidly held parallel to each other by a plurality of sleeper members positioned at regular intervals along a main length of the rails. Many different materials are known for use in forming sleeper members, for example wood, steel and concrete.

Modern methods of laying of railway track typically fall into one of two types. A first type of track laying method is known as single-track renewal wherein track components i.e. separate sleepers and lengths of rail are transported to the track laying site on a flat bed-type railway cargo wagon. Single-track renewal/laying takes the form of laying track in front of the cargo wagon such as to extend the track upon which the cargo wagon is mounted. As more track is laid the wagon is progressed down the track and so the track length is extended. A crane or hoist is typically operable to move between the cargo wagon where sleepers and rail length are stored to the track-laying site.

A second mode of track renewal comprises parallel track renewal wherein the track being laid or renewed is parallel to an existing track. A set of cargo wagons carrying the track components e.g. sleepers and length of rail is moved along side the site of an area of track due for renewal or for first laying. Cranes separate to the wagons then operate to individually unload single sleepers from the wagons which are then laid and to which separate rail lengths are then fixed into position.

Both of these prior art track laying/renewal methods are time inefficient.

The typical time taken for laying a 300 yard length of track comprising multiple 60 foot track panels, each made up of 28 sleepers and 2 rails, is typically in the region of 5 to 6 hours.

SUMMARY OF THE INVENTION

It is an object of the present invention to improve the speed of laying or renewal of railway track and sleepers.

It is a further object of the present invention to provide for the laying of sections of railway track or sets of sleepers in a single laying operation.

The inventors have realized that the speed of railway track laying and renewal can be significantly improved if multiple sections of track or sleepers can be laid in one operation.

The inventors have therefore provided a parallel track renewal/laying system comprising apparatus for the transport of sections of railway track or sleeper sets to a track laying/renewal site. The inventors have further provided means to deploy sections of track or sleeper sets from a transport wagon, or series of transport wagons in train formation, to a parallel track-laying site. The inventors have further provided means to stabilise the track/sleeper laying apparatus during track/sleeper deployment.

The inventors have thereby provided a means and method of deploying railway track or sleepers to a track renewal/laying site in multiple lengths of up to 60 feet comprising a sleeper set or a panel of track comprising a plurality of sleepers and two lengths of rail.

The inventors have provided a method of deployment of a plurality of spaced apart railway sleepers from at least one flat bed wagon onto a railway track bed in a single operation. By simultaneously conducting the deployment method from a plurality of adjacent wagons forming a train, a plurality of sleepers extending over a length of the train can be laid.

The inventors have further provided a method of filling in the gaps between sets of laid sleepers formed at the adjacent track bed between individual flat bed wagons.

In the case where a plurality of panels of track are laid around a curved track bed, the sleepers and track extend along a plurality of tangential lines forming a polygon such that for each panel of track laid from a corresponding respective wagon the track panel lays in a straight line, a smoothing operation is applied to the polygonal segments to move the plurality of sleepers and track lengths such that the line passing perpendicular to a main length of each sleeper is modified from a polygonal segment to a smooth curve.

According to a first aspect of the present invention there is provided a rail wagon configured for deployment of railway track to a track bed adjacent said wagon, said wagon comprising:

a flat bed capable of carrying at least one panel of track, and comprising one or more bogies supporting said flat bed; and at least one crane hoist for lifting a said panel of track from a position on said flat bed to a track bed adjacent said wagon.

According to a first specific method of the present invention there is provided a method of deployment of a panel of track from a rail wagon, said method comprising the steps of:

in a single operation, lifting a panel of track from a flat bed rail wagon;

transferring said panel in a direction transverse to a main length of said wagon; and lowering said panel onto a track bed adjacent to said wagon.

According to a second aspect of the present invention there is provided a rail wagon configured for deployment of a sleeper set to a track bed adjacent said wagon, said wagon comprising:

a flat bed configured for supporting a plurality of sleepers, and one or more bogies supporting said flat bed; and at least one crane hoist for lifting said sleeper set from a position on said flat bed to a track bed adjacent said wagon.

According to a second specific method of the present invention there is provided a method of laying a sleeper set in a single operation from a rail wagon, said method comprising the steps of:

lifting a plurality of spaced apart sleepers from a flat bed of said wagon;

transferring said sleepers in a direction transverse to a main length of said wagon; and lowering said sleepers onto an adjacent track bed.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIG. 1 illustrates the track deployment wagon of the present invention in accordance with the first embodiment.

DETAILED DESCRIPTION OF THE BEST MODE FOR CARRYING OUT THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

In this specification the term track refers to railway track, a section of which comprises the combination of a plurality of sleepers upon which two rails are mounted.

In this specification a panel of track refers to a section of pre-assembled track. The length of a panel is variable but typically comprises an approximately 60 foot (18 meters) length of pre-assembled track suitable for directly laying at a track renewal/laying site.

In this specification the term sleeper set refers to a plurality of sleepers laid simultaneously at a track renewal/laying site. The laying of a sleeper set forming a base layer upon which rail can be mounted.

Figure 1C:
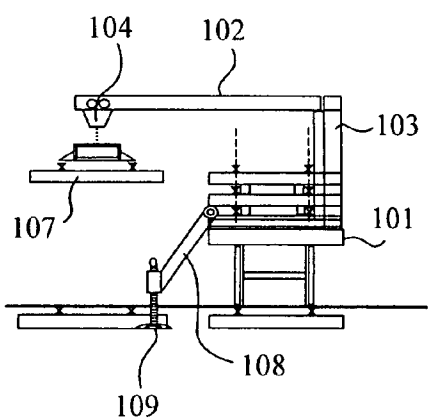
FIG. 1B illustrates a plan view of the wagon and FIG. 1C illustrates an end on view of the wagon during track deployment.
Figure 1A:
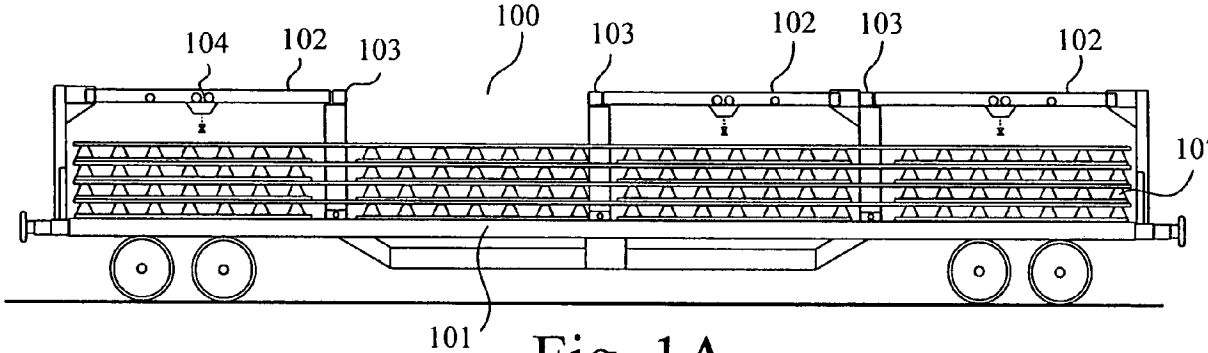
FIG. 1A illustrates a side view of the wagon.
Figure 1B:
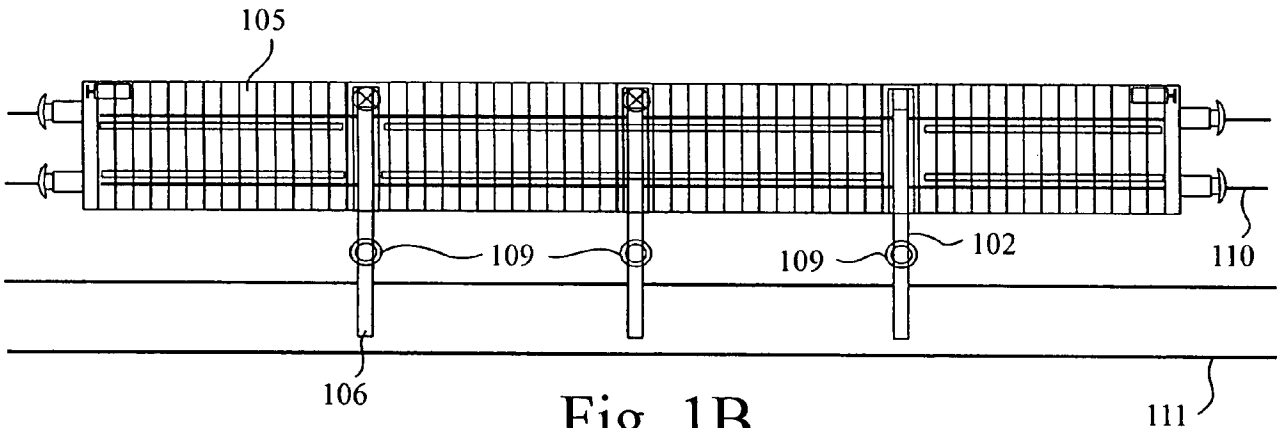

Referring to FIG. 1A herein, there is illustrated diagrammatically a side view of a track deployment wagon 100 according to a first embodiment of the present invention. The wagon 100 comprises a flat bed railway transporting cargo truck, the chassis forming a flat bed 101 upon which the cargo is mounted. In the first embodiment of the present invention wagon 100 comprises at least one crane or hoist 102. FIGS. 1A and 1B illustrate 3 hoists 102 each hoist comprising an upright support structure comprising a reinforced metal girder having a main axis extending substantially perpendicularly to the flat bed surface 101. The hoist 102 is formed by an arm extending transversely outward from a region of the support structure 103 distal to the flat bed 101. A moveable winch 104 is mounted on the outwardly extending arm.

Referring to FIG. 1B herein, hoist 102 is moveable from a first transit position 105 to a second operational position 106. The operational position providing the functional position in which track or sleepers can be laid.

Referring to FIGS. 1A, B, and C herein, wagon 100 is loaded with up to 4 panels of track stacked upon the main flat bed surface 101. In this first specific embodiment each panel comprises a pre-formed section of track formed from 28 evenly spaced sleepers and two sections of rail mounted on said sleepers. The panel is approximately 60 feet (18 meters) in length and extends substantially the entire length of the flat bed surface 101.

Referring to FIG. 1C herein there is illustrated an end on view of the wagon 100 of the first embodiment illustrating the hoist 102 comprising support structure 103 and hoist arm 102 in the operational position. A first panel is mounted upon the hoist 104 and is being moved into a position for track laying. FIG. 1C further illustrates the wagon 100 to comprise an outrigger member. This outrigger member comprises an arm portion 108 extending from the wagon chassis and supported at the end of the arm distal to the wagon chassis by a foot member 109. Together the arm and foot form a stabilizing outrigger, the foot portion 109 providing a stabilizing surface which can be placed in contact with a main ground surface. The outrigger is hydraulically operated to firmly engage with the ground surface to support and stabilize wagon 100.

Figures 2A, 2B, 2C:
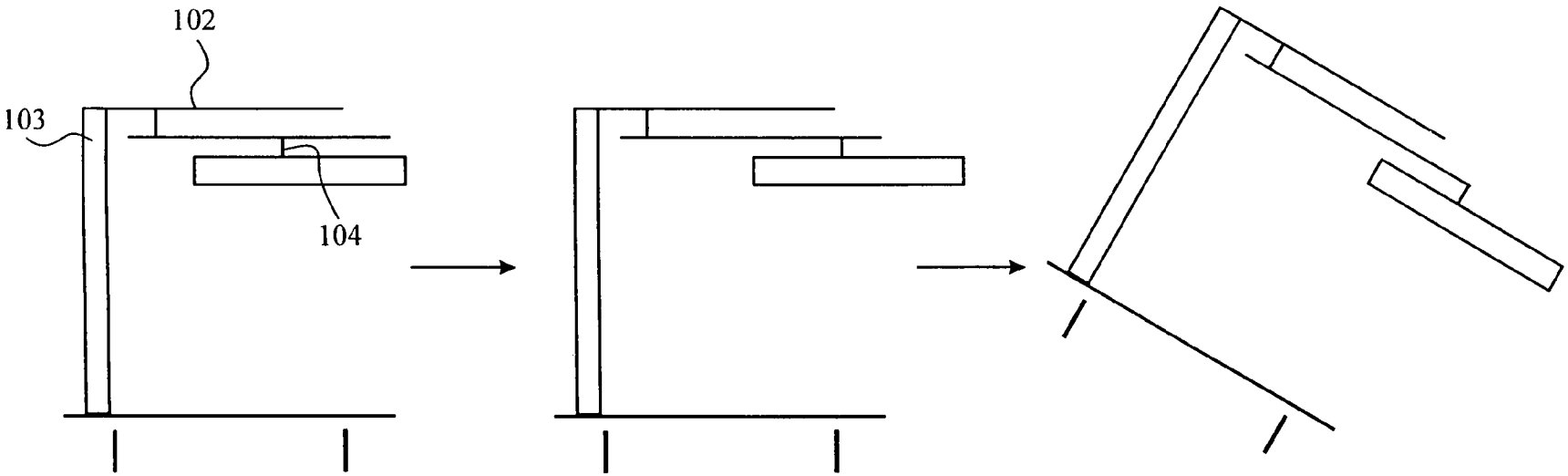
FIG. 2 illustrates schematically the problems associated with wagon tipping during deployment of heavy sections of track.

As a panel 107 is lifted from the wagon 100 and transported along hoist arm 102 towards a track laying site which is substantially parallel to the track upon which the wagon is mounted the turning moments at the intersection of hoist arm 102 and support structure 103 increase urging the wagon 100 to tip in the direction of the track laying site. This problem is illustrated in FIG. 2. Referring to FIGS. 2A, B and C, in the absence of an outrigger, where a heavy panel or sleeper set is moved from the wagon in an outward direction in order to lay track at a parallel site the turning moments increase tending to tip the wagon. Clearly this is a dangerous and unwanted effect. Further referring to FIG. 1C the outrigger provides a stabilizing effect to prevent tipping of the wagon 100 during track or sleeper deployment.

Outriggers are not always required during track deployment. Outriggers are typically required where the panel of track or sleeper set being deployed is heavy such that wagon tipping can occur. Typically outriggers are required during deployment of panels of track or sleeper sets comprising concrete sleepers. In these situations at least one outrigger is required although typically one outrigger is provided per hoist 102. FIG. 1B illustrates the situation wherein each outrigger is mounted directly beneath each hoist, a support foot 109 placed on the ground surface between the existing track 110 upon which wagon 100 is mounted and the track deployment site 111.

Figure 3:
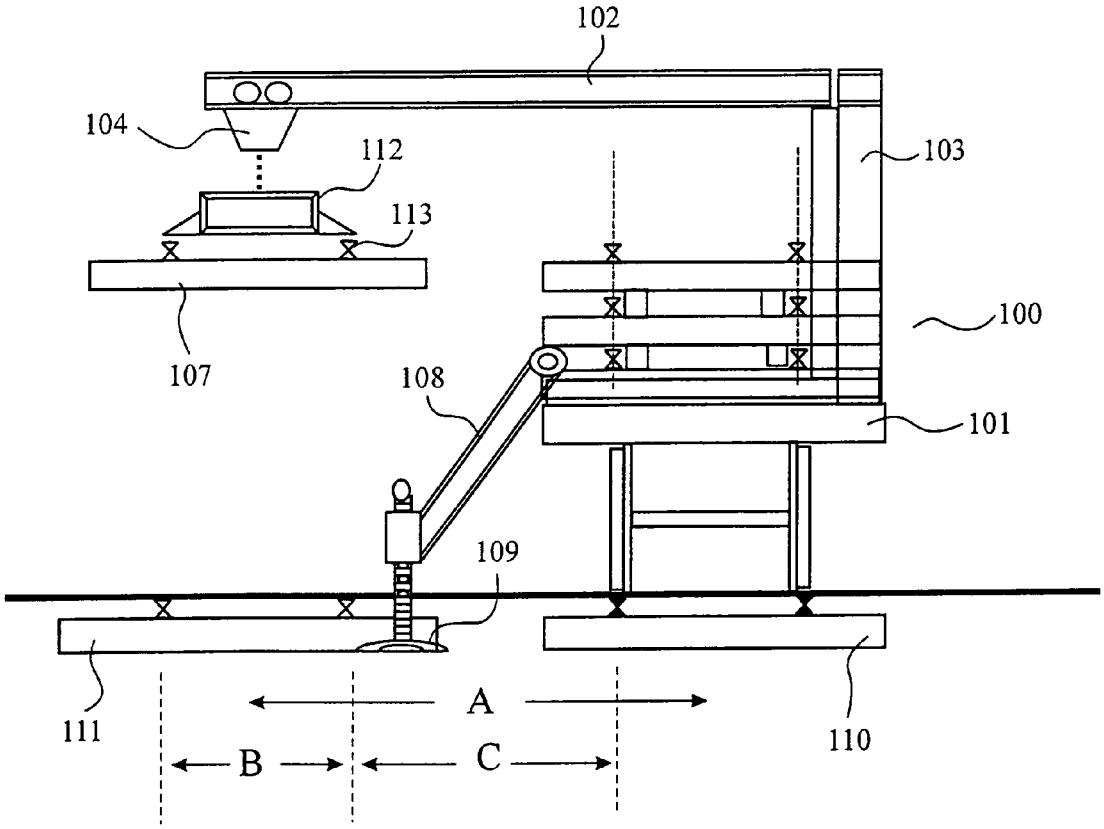
FIG. 3 illustrates an enlarged end on view of the track deployment wagon according to the first embodiment illustrating a stabilizing foot preventing wagon tipping during track deployment.

Referring to FIG. 3 herein there is illustrated an enlarged end on view of the wagon 100 of the first embodiment. FIG. 3 illustrates the hoist 102 in operational position having picked up a panel of track 107 via hoist 104 and a mounting means 112 lifting the panel via the rails 113. Outrigger arm 108 has been deployed to locate outrigger foot 109 at a ground surface thereby stabilizing the wagon 100. The outrigger is adjustable such that the outrigger arm 108 is moveably mounted at the foot portion 109 to accommodate uneven ground surfaces or variation in the level of ground surface.

FIG. 3 further illustrates the typical average spacing between parallel tracks. The average distance between rails on a single track, the track gauge, B, is typically 1.43 meters.

The distance between rails on adjacent parallel tracks, C, is typically 6 feet (1.8 meters). The distance between the centre of two adjacent tracks, A, is typically 10 feet (3.03 meters).

Further referring to FIGS. 1 and 3 herein a first specific method of track deployment is provided. A plurality of wagons 100 are each loaded with at least one panel of track. The plurality of wagons are typically arranged on a single track to form a train. The train typically comprises 5 track deployment wagons and a generator wagon comprising a power generation unit to supply power to each of the hoists 102 to drive movement of the hoist from the transit position to the operational position and for movement of the winch 104. The generator unit further providing a power supply to drive positioning of the hydraulic outrigger foot 109. An engine unit is further comprised at one end of the train for transport of the train of track deployment wagons to the track renewal/laying site.

Following transport of the track deployment train to the track laying/renewal site each track deployment wagon is positioned adjacent to the track laying region. Hoist arms 102 are moved from the transit position 105 to the operational position 106 under control of motor units powered by the generator set. Where necessary, outrigger foot 109 is deployed to maintain stability of the wagon 100 during track deployment. Once the hoist arms 102 are in the operational position the panel of track is connected to hoist 104 via mounting means 112 connecting to the track rails 113. A single track panel is then hoisted from the wagon 100, lifted and transferred along the hoist arm 102 until it is located approximately directly above the track laying site 111. The panel of track is then lowered into position. The hoist 104 and mounting means 112 is retracted from the panel leaving a single panel in position. Whilst each panel of track is laid separately from an individual track deployment wagon, by incorporating several wagons and typically 5, to form a train, adjacent panels of track can be laid simultaneously in a single track deployment operation. Each wagon typically lays a 60 foot length of track. In this way, up to 300 feet of track can be laid in a single operation, this operation taking approximately fifteen minutes to complete. Adjacent rail sections are then connected by means known to the man skilled in the art e.g. by use of the thermite reaction. Where 5 track deployment wagons are used in a single train a 300 foot length of track is laid in a single operation. The hoist arms 102 are then returned to the transit position 105, the track deployment train is moved to the next adjacent track laying site and the track deployment operation cycle can be repeated to lay the next adjacent portion of track.

In many instances track will be laid along non-linear renewal/laying sites. Where a track to be laid is required to have a curved form multiple panels of track are initially laid wherein each panel is linear, adjacent panels being slightly offset such as to follow the general form of the curve of the track renewal/laying site. The result is a plurality of tangential lines of track panels which form a polygon outlining the general shape of the desired curve. Once the track has been laid in this manner a smoothing operation is applied to the connected rails and sleepers to modify the laid track from the polygonal segmented form to a smooth curve. This smoothing operation involves the use of known prior art tapping machines moving along the rails and applying a pressure to the rails to introduce a desired curve.

Figure 4:
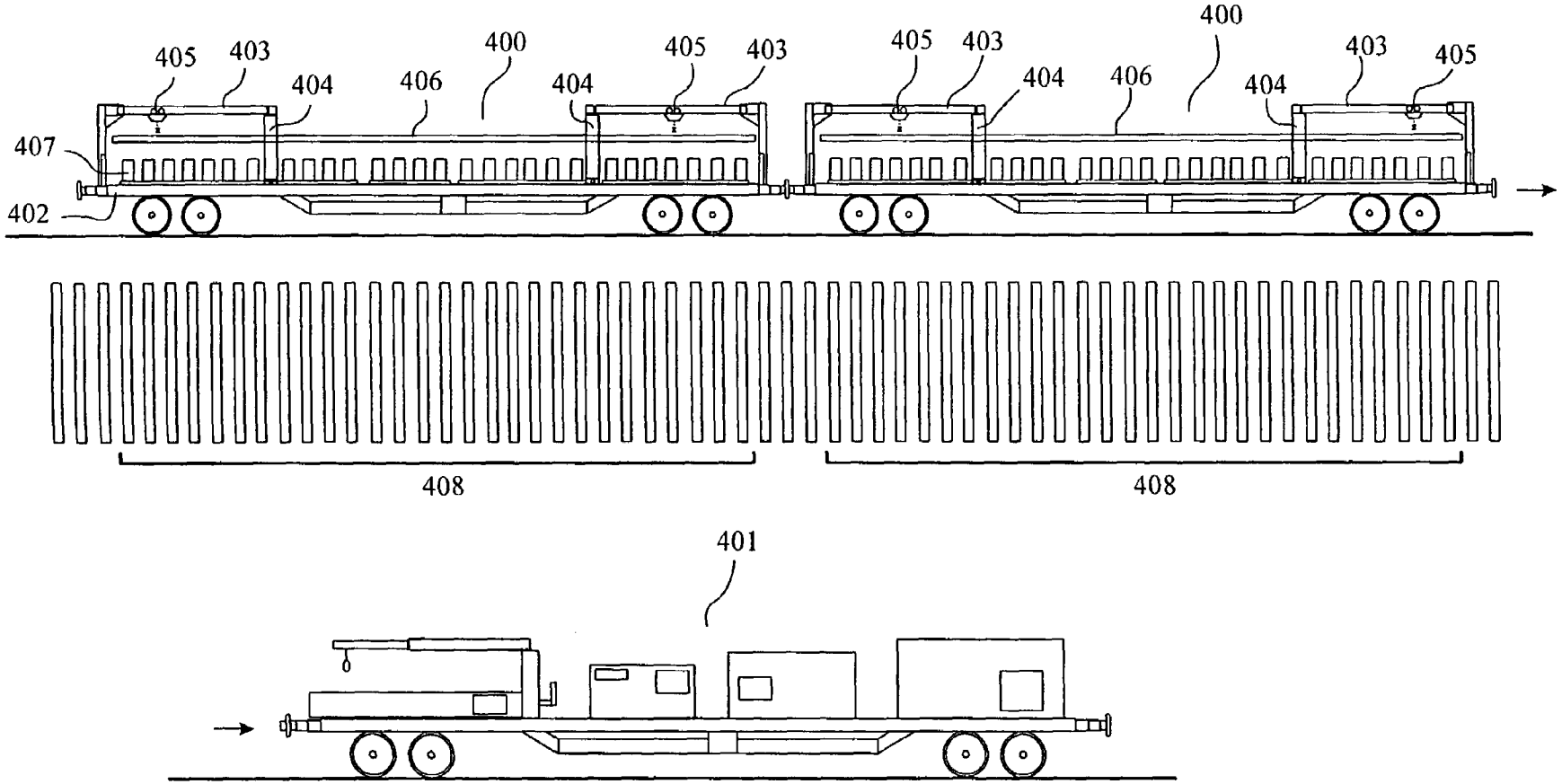
FIG. 4 illustrates two track deployment wagons and a generator wagon connected as part of a deployment train according to the second embodiment of the present invention.

Referring to FIG. 4 there is illustrated two deployment wagons 400 according to the second specific embodiment of the present invention and a generator wagon 401 connected together to form a deployment train. The second embodiment of the present invention is concerned with the deployment of sleeper sets where the sleepers comprise metal sleepers, typically made from steel. Each of the deployment wagons 400 comprises a substantially planar base 402 mounted on a chassis with bogies mounting the wagon upon a first track. Sleeper set deployment being to an adjacent substantially parallel track renewal/laying site. Wagon 400 further comprises at least one hoist and typically two or more hoists 403. Each hoist comprising an arm connected to a support structure 404, each arm having a winch 405 moveable along the hoist arm 403. During transit the hoist arm is in a transit position substantially in line with the main longitudinal length of the deployment wagon. Once the deployment site has been reached the hoist arm is released and maneuvered into position such as to extend transversely outwardly from the main longitudinal length of the deployment wagon and across the adjacent deployment site. This movement is powered via motors on the deployment wagon 400 driving movement of hoist arm 403 about support structure 404. This is powered by the generator wagon 401.

In the second embodiment a set of steel sleepers, typically comprising 28 steel sleepers, each of approximately 2 meters length and distributed evenly over a 60 foot length, corresponding to the length of deployment wagon base platform 402, is deployed in a single step to a deployment site. The steel sleepers are stacked at predetermined intervals upon the deployment wagon. Steel sleepers can be stacked conveniently in stacks of 10. At least one bar or beam 406 extending the length of the deployment wagon 400 is provided mounted on at least one of the winches 405 and typically to each winch on a single deployment wagon 400. The beam provides a mounting means for mounting each of the sleepers to be deployed. Whilst a single broad beam is sufficient for deployment of a steel sleeper set, two adjacent beams 406 in approximately parallel configuration provide a stable means of deploying the steel sleeper set. Each beam 406 is provided with means to mount a sleeper set such as to attach beam 406 to a single sleeper 407 at predetermined intervals along beam 406 such as to mount a single sleeper set comprising 28 sleepers spaced evenly along the beam which can be lifted from the wagon 400 and deployed at the adjacent deployment site in a single step.

Steel sleepers are significantly lighter than concrete sleepers and it is possible to lay a single sleeper set comprising 28 sleepers evenly spaced along an approximately 60 foot length in accordance with the second embodiment of the present invention without the need to deploy an outrigger foot of the type described for the first embodiment of the present invention. However, this is not limiting and wagons 400 according to the second embodiment of the present invention may optionally further comprise at least one stabilizing outrigger foot portion deployable at the deployment site to stabilize wagon 400 during sleeper set deployment.

In accordance with the second embodiment of the present invention and further referring to FIG. 4 herein a second specific method of the present invention is provided. In this method a deployment train comprising a plurality of deployment wagons 400 mounted with stacks of steel sleepers 407 spaced at predetermined intervals to form a sleeper set are loaded on the deployment wagon base surface 402. The deployment train further comprises a generator wagon to power deployment of the sleeper set and an engine vehicle for transport to the deployment site. Following transport to the deployment site the hoist arms 403 are moved into operational position for deployment of the sleeper set. The at least one beam or bar 406 mounted on hoist 405 is connected to the uppermost steel sleeper of each sleeper stack 407. Lifting of the hoist results in lifting of an entire sleeper set 408. The hoists are then moveable along arms 403 until they are directly above the deployment site wherein the winch 405 lowers the sleeper set 408 into position. By having a plurality of deployment wagons in a line forming a train several sleeper sets can be laid down in a single operation. Once in position the lifting bar 406 is detached from the sleepers, the winch 405 retracts the bar 406 to be substantially above the main base platform 402 of the wagon 400. Each hoist arm is then unlocked from the operational position and moved to the transit position and locked in place for transit, a bearing in the winch 405 mounting enabling the bar 406 to remain in approximate alignment with the main longitudinal body of the wagon 400.

Deployment of sleeper sets according to the second specific method leaves a small gap between sleeper sets equivalent to the gap between adjacent deployment wagons. This gap is filed with sleepers, typically 2 or 3 sleepers, by an electromagnetic manager deploying sets of 2 or 3 sleepers filling the spaces between sleeper sets. This occurs after the main deployment. Following filling of gaps between sleeper sets a continual row of sleepers is in position and suitable for mounting of rail to form continuous track.

Figures 5A, 5B:
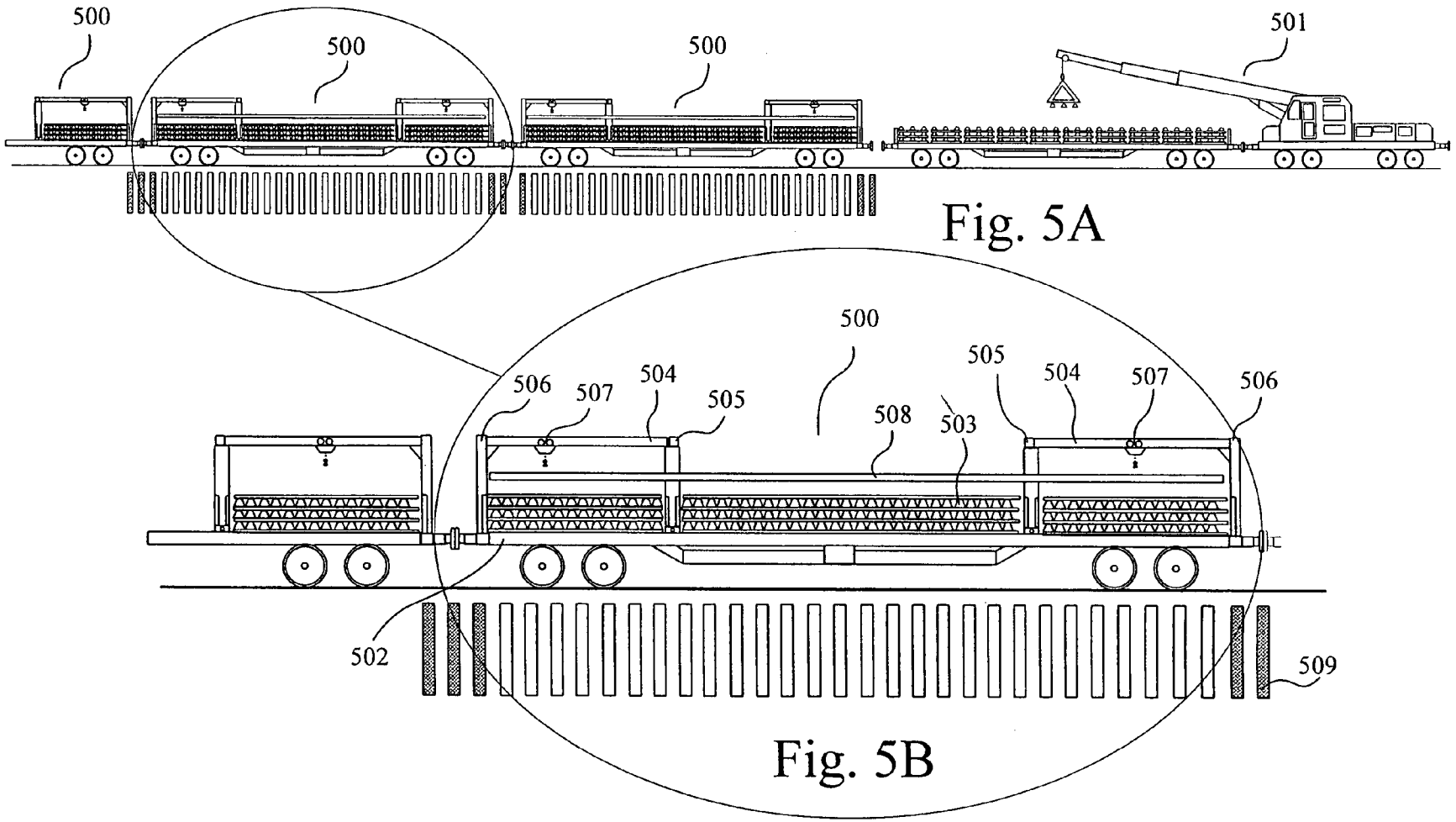
FIG. 5A illustrates a side view of the track deployment wagons of the third embodiment of the present invention, additionally illustrating a hoist wagon for transferring sleepers and/or track from an adjacent flat bed wagon to a track renewal/laying site.
FIG. 5B illustrates an enlarged view of a single track deployment wagon of the third embodiment of the present invention.
Figure 6:
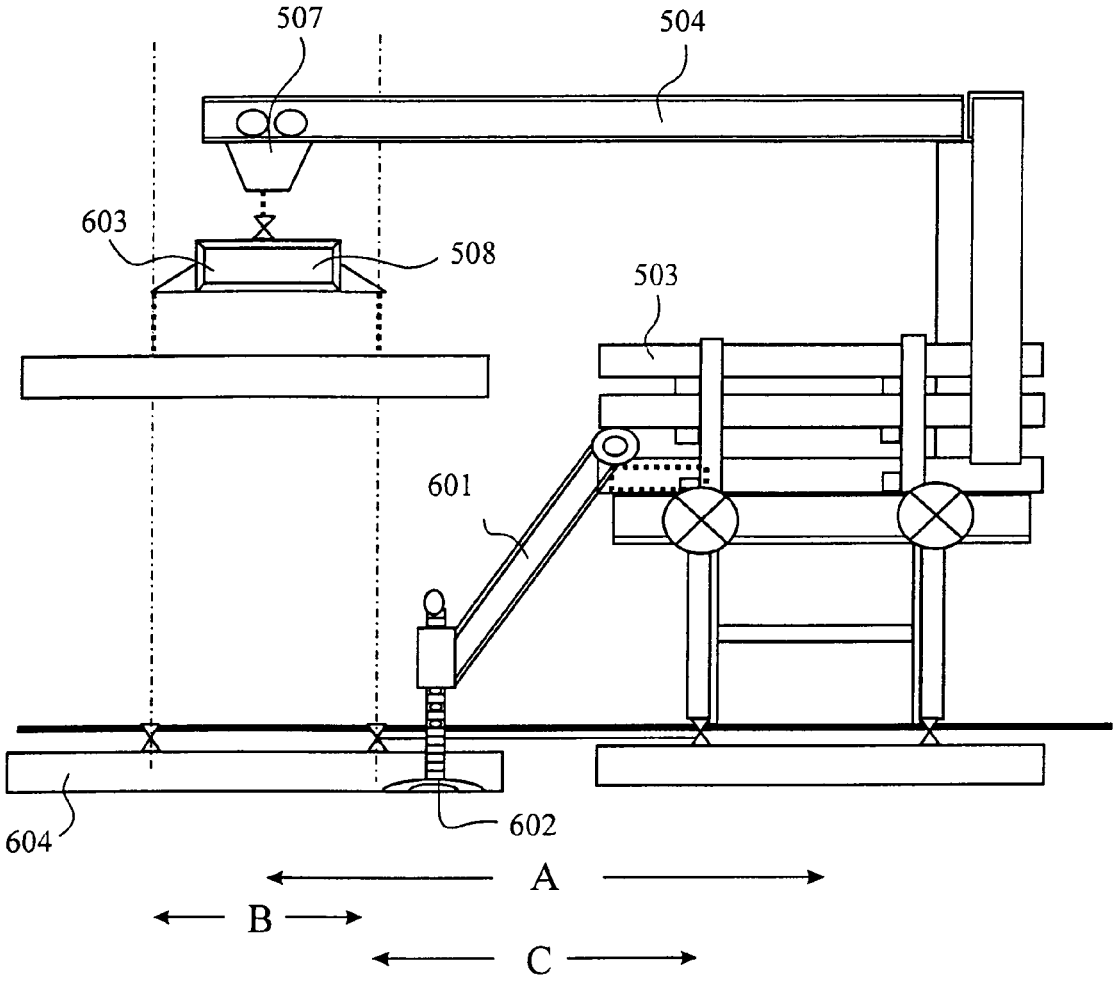
FIG. 6 illustrates an enlarged end on view of a track deployment wagon according to the second and third embodiments of the present invention illustrating a stabilizing foot preventing tipping of the wagon.

FIGS. 5, 6 and 7 illustrate aspects of a third specific embodiment of the present invention. FIG. 5A illustrates part of a sleeper deployment train comprising a plurality of deployment wagons 500. The combination of a flat bed wagon and heavy duty hoist wagon are illustrated at one end of the train 501. An enlarged view of deployment wagon 500 is illustrated in FIG. 5B.

Referring to FIG. 5B herein the sleeper deployment wagon 500 comprises at least two bogies for mounting the wagon on two rails of a length of railway track. A chassis provides a flat bed base 502 upon which at least one layer of sleepers 503 are stacked. FIG. 5B illustrates three stacks of sleepers, each layer comprising approximately 56 sleepers along an approximately 60 foot length of the wagon 500. The third embodiment of the present invention is concerned with the deployment of concrete sleepers and other sleepers made of materials heavier than steel. At least one hoist 504 is provided per wagon, FIG. 5B illustrates a wagon comprising two hoists 504. Each hoist 504 comprises an arm pivotable about an upright support structure 505. The arm is moveable between an operational position wherein the hoist arm 504 is extending across a parallel section of track and a transit position wherein the hoist arm is engaged at a locking member 506 so as to retain the hoist arm within the general longitudinal confines of the wagon body during transit. A winch 507, moveable along the hoist arm 504 is provided. As with the second embodiment of the present invention a bar or beam 508, typically a steel or iron bar, extends substantially the entire length of the wagon body. The bar or beam 508 provides a means of mounting and lifting sleepers stacked on the wagon chassis such as to move them into position at a parallel track renewal/laying site.

Referring to FIG. 6 herein there is illustrated an end on view of the deployment wagon 500 and the parallel track renewal site 604 in accordance with the third embodiment of the present invention. FIG. 6 illustrates the hoist arm 504 to be in an operational position wherein the winch 507 is supporting a sleeper set via beam 508 above a track renewal site 604. In the third embodiment of the present invention the deployment wagon comprises an outrigger foot or stay 602 supported by an arm 601 extending from the main body of the deployment wagon. Arm 601 and foot 602 are configured to engage a ground surface adjacent the track renewal site to stabilize and support the deployment wagon during lifting of heavy sleepers from the deployment wagon towards an adjacent sleeper renewal site preventing tipping of the wagon. Arm 601 and foot 602 are hydraulically operated and adjustable via control means to accommodate for variations in the ground surface of the track renewal/laying site. Distances A, B and C correspond to those described in respect of FIG. 3 above.

Figures 7A, 7B, 7C:
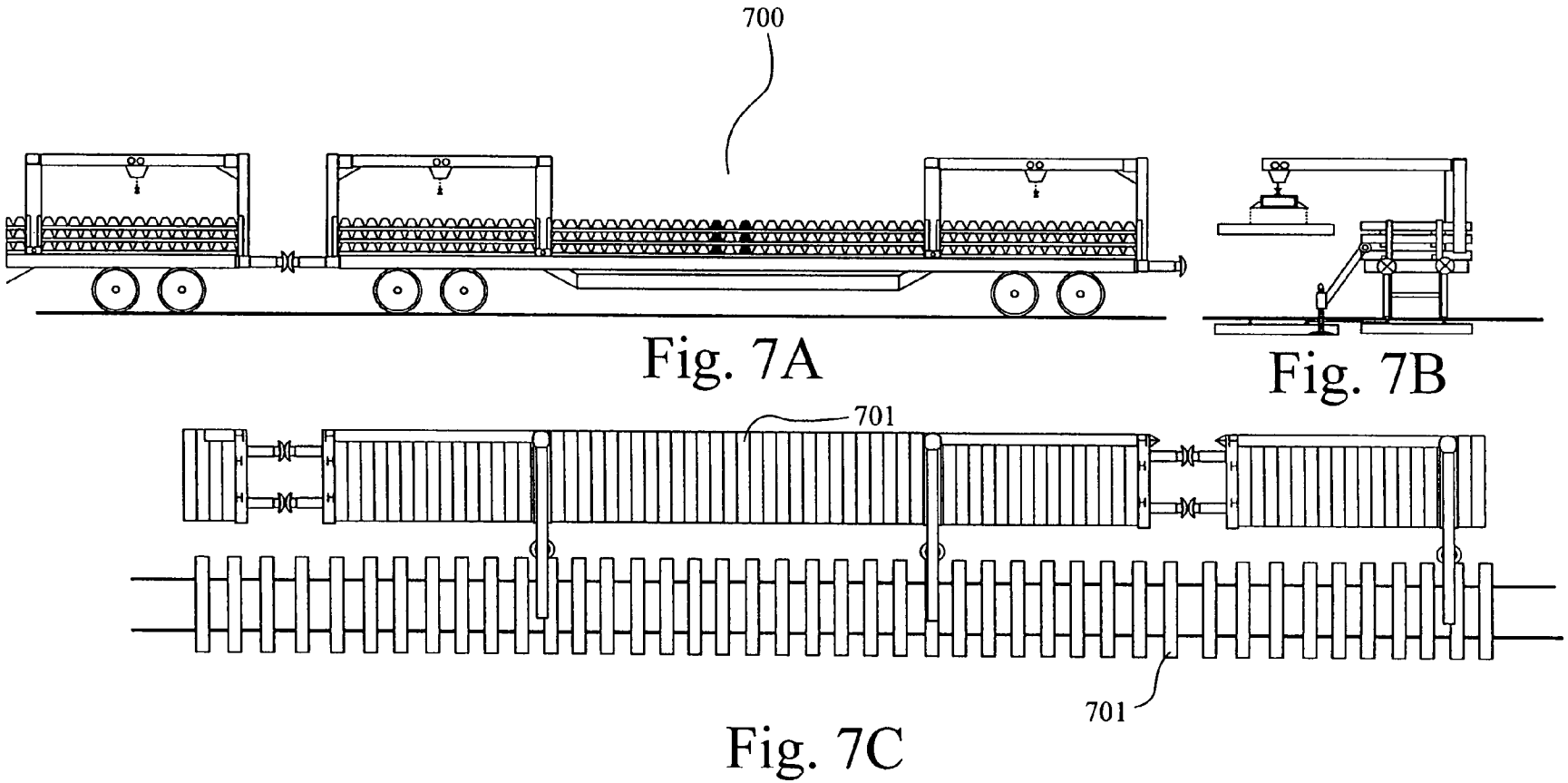
FIG. 7 illustrates a track deployment wagon according to the third embodiment of the present invention, FIG. 7A illustrating a side on view, FIG. 7B illustrating an end on view and FIG. 7C illustrating a plan view of a parallel track renewal/laying operation.

Referring to FIG. 7 herein an alternative arrangement of the deployment wagon according to the third embodiment of the present invention is illustrated. FIG. 7A illustrates a side on view of the wagon 700 loaded with three layers of concrete sleepers. FIG. 7B illustrates an end on view of the wagon during sleeper deployment and FIG. 7C illustrates a plan view of the wagon and adjacent renewal site during sleeper deployment. The main difference between the deployment wagons illustrated in FIG. 5A and FIG. 7A to C is in the arrangement of sleepers stacked on the wagon. In FIGS. 7A and C each layer of sleepers comprises 56 sleepers to be laid adjacent to a stationary deployment wagon and two additional spacer sleepers for in-filling of the track site being laid between sleeper sets. The wagon illustrated in FIGS. 5A and B comprises layers of sleepers having 56 sleepers to be laid at adjacent renewal sites and at least three spacer sleepers 509.

In accordance with the third embodiment of the present invention described above there is provided a third specific method of sleeper set deployment. Referring to FIG. 5B herein a sleeper deployment wagon 500 is initially loaded with at least one sleeper set. A sleeper set typically comprising at least 14 sleepers. FIG. 5B and FIG. 7A both illustrate deployment wagons wherein each layer of sleepers comprises four sleeper sets, i.e. at least 56 sleepers plus any additional spacer sleepers required. Once loaded the deployment wagon forms part of a train, typically comprising 5 deployment wagons, a power generation wagon and an engine vehicle. This deployment train is transported to the track renewal/laying sites. Once in position adjacent a parallel renewal/laying site the hoist arms 504 are unlocked from the locking member 506 and moved about the support structure 505 by means of a powered movement. The hoist arms are thereby moved from the transit position to an operational position. At least one outrigger foot 602 is extended via arm 601 from the deployment wagon to be placed on the ground surface between the deployment wagon and the track renewal/laying site. This movement is powered from the power generation set and is operated hydraulically. Whilst a minimum of one outrigger is required for the deployment of heavy sleeper sets e.g. concrete sleepers a plurality of outriggers may be deployed per wagon 500. Once the hoist arm 504 has been moved into the operational position beam 508 is fastened to a first sleeper set comprising 14 sleepers spaced equidistantly along the 60 foot beam length. Once fastened this first sleeper set is winched from the deployment train, the winch 507 is moved along hoist arm 504 until the first sleeper set is positioned above the sleeper deployment site. The first sleeper set is then lowered into position. Deployment of the first sleeper set results in 14 sleepers deployed along a 60 foot track length. The normal required number of sleepers along this length is 28. Therefore, the process is repeated by fastening the bar 508 to an alternate sleeper set of the uppermost layer of sleepers mounted on the deployment wagon. This second sleeper set is winched to raise the sleeper set from the deployment wagon, moved into position above the sleeper deployment site and lowered. The sleeper set is lowered such as to deploy the second sleeper set between the first previously deployed sleeper set. The result is a single deployed sleeper set comprising 28 equidistant deployed sleepers comprising two sleeper sets each of 14 sleepers, the two sleeper sets having been laid alternately. The uppermost layer of sleepers mounted on the deployment wagon still comprises a remaining 28 sleepers which, once the deployment train has been moved to a deployment position further along the track upon which the deployment wagon is mounted, can be laid at a sleeper renewal/laying site by repetition of the above described operation. In this way 56 sleepers comprised in one sleeper layer mounted on deployment wagon 500 can be used to deploy two 60 foot sleeper sets each comprising 28 sleepers by the deployment of four alternating sets of 14 sleepers.

The deployment of sleepers according to the third specific method generally leaves a gap between each set of 28 sleepers which is required to be infilled. FIG. 5B illustrates an arrangement wherein the sleeper width is such as to require an infill of three sleepers between each 28 sleeper set. The arrangement illustrated in FIG. 7C is such that the width of each sleeper is so as to require an infill of two sleepers between each set of 28 sleepers. In both cases, this infill is performed by hoisting a requisite number of spacer sleepers 509, 701 from the deployment wagon to the appropriate deployment site. Both FIG. 5B and FIG. 7 illustrate sleeper layers comprising pre-determined spacer sleepers 509, 701. In an alternative arrangement, each gap between deployed sets of 28 sleepers are filled in after the main deployment event by a separate wagon which may be attached to the end of the main deployment train carrying spacer sleepers for infill of the gaps between main sleeper sets.

In accordance with the third embodiment of the present invention and the first specific method a deployment train comprising five deployment wagons 500, each wagon comprising three sleeper layers wherein each sleeper layer comprises at least 56 sleepers plus additional spacer sleepers enables 1800 feet of sleepers to be laid. This being a result of two 28 sleeper sets, each being of approximately 60 foot in length deployed per layer of sleepers mounted on the deployment wagon. Each wagon comprising at least three layers and therefore deploying at least 360 feet of sleeper sets per wagon. A train of five wagons thereby deploying approximately 1800 feet in track length of sleepers.

What is claimed is:

1. A train comprising a plurality of adjacent rail wagons configured for deployment of railway track to a track bed adjacent each wagon, each wagon comprising:

a flat bed capable of carrying at least one panel of said track, and comprising one or more bogies supporting said flat bed; and at least one crane hoist for lifting a panel of track from a position on said flat bed to a track bed adjacent said wagon.

2. A train as claimed in claim 1 further comprising a generator car for the supply of power of said wagons.

3. A train as claimed in claim 1, each wagon further comprising at least one stabilizing member extendable from said wagon to stabilize said wagon during deployment of said sleepers.

4. A train as claimed in claim 3, wherein said stabilizing member is deployed substantially directly underneath said crane hoist during deployment of said panel.

5. A train as claimed in claim 3, wherein said stabilizing member comprises an arm portion connected at a first end to a region of a chassis of said rail wagon, and further connected at a second end to a foot portion, said foot portion configured to engage a ground surface adjacent said wagon.

6. A method of laying a plurality of panels of track from adjacent rail wagons forming a train, each panel being laid by the steps of:

lifting the panel of track from a flat bed of each rail wagon with a crane hoist on each rail wagon; and transferring said panels in a direction transverse to a main length of said wagons; and lowering said panels onto a track bed adjacent to said wagons.

7. The method as claimed in claim 6, wherein said method further comprising the step of moving said crane hoists from a first transit position to a second operational position prior to lifting said panels from said wagons.

8. The method of claim 6, further comprising, in a single operation, laying the panels from each wagon.

9. The method as claimed in claim 6, further comprising the step of deployment at least one stabilizing member prior to said transfer of said panels.

10. The method of claim 6, further comprising the step of applying a smoothing operation to the plurality of laid panels.

11. A train comprising a plurality of adjacent rail wagons, each rail wagon being configured for deployment of a sleeper set comprising a plurality of sleepers to a track bed adjacent each wagon, each wagon comprising:

a flat bed configured for supporting the sleeper set, and one or more bogies supporting said flat bed; and at least one crane hoist for lifting said sleeper set from a position on said flat bed to a track bed adjacent said wagon.

12. A train as claimed in claim 11 wherein said sleeper set is connected by at least one mounting means, said at least one crane hoist is configured to lift said mounting means and thereby said sleeper set.

13. A train as claimed in claim 11 further comprising at least one stabilizing member extendable from each wagon to stabilize said wagons during deployment of a said sleeper set.

14. A train as claimed in claim 13 wherein each stabilizing member comprises an arm portion connected at a first end to a region of the chassis of said rail wagon, and further connected at a second end to a foot portion, said foot portion configured to engage a ground surface adjacent said wagons.

15. A train as claimed in claim 14 wherein said stabilizing member is deployed substantially directly underneath said crane hoist of each wagon during deployment of a said sleeper set.

16. A method of laying a plurality of sleeper sets from adjacent rail wagons forming a train, each sleeper set comprising a plurality of spaced apart sleepers and being laid from said adjacent rail wagons, said method comprising laying each sleeper set from a respective said rail wagon by the steps of:

lifting a sleeper set from a flat bed of said wagons by a crane hoist of each wagon;

transferring said sleeper set in a direction transverse to a main length of said wagon; and lowering said sleepers set onto an adjacent track bed.

17. A method as claimed in claim 16, further comprising the step of moving said at least one crane hoist from a first transit position to a second operational position prior to lifting said sleeper sets.

18. A method as claimed in claim 16, further comprising the step of deploying at least one stabilizing member from each rail wagon prior to said transfer of said sleeper sets.

19. A method as claimed in claim 18, further comprising the step of moving said at least one crane hoist from a first transit position to a second operational position prior to lifting said sleepers.

20. A method as claimed in claim 16 further comprising the step of infilling of gaps between laid sleeper sets between individual flat bed wagons.

21. A method as claimed in claim 16 comprising, in a single operation, laying the panels from each wagon.

22. A method of laying a sleeper set in a single operation from a rail wagon, said method comprising the steps of:

lifting a plurality of spaced apart sleepers from a flat bed of said wagon;

transferring said sleepers in a direction transverse to a main length of said wagon;

lowering said sleepers onto an adjacent track bed;

laying a first sleeper set, taken from a single layer of sleepers carried on said wagon, to said track bed in a first operation; and laying a second set of alternate sleepers, carried from said same layer, in positions between individual sleepers of said first sleeper set.

* * * * *